United States Patent [19]

Malk

[11] 4,011,600

[45] Mar. 15, 1977

[54] ADJUSTING DEVICE FOR HAT WITH SWEAT BAND

[75] Inventor: Marvin I. Malk, Denver, Colo.

[73] Assignee: Imperial Caps, Inc., Denver, Colo.

[22] Filed: Sept. 27, 1973

[21] Appl. No.: 401,286

[52] U.S. Cl. ..... 2/183; 2/197

[51] Int. Cl.[2] ..... A42B 1/22

[58] Field of Search ..... 2/183, 197, 237, 181, 2/181.2, 181.4, 181.6

[56] References Cited

UNITED STATES PATENTS

| | | | |
|---|---|---|---|
| 823,314 | 6/1906 | Adams | 2/183 |
| 1,513,682 | 10/1924 | Weinstein | 2/197 |
| 1,764,505 | 6/1930 | Carlson | 2/197 |
| 3,714,670 | 2/1973 | Finsilver et al. | 2/197 |

FOREIGN PATENTS OR APPLICATIONS

| | | | |
|---|---|---|---|
| 209,509 | 5/1909 | Germany | 2/183 |

OTHER PUBLICATIONS

Gershman, *Self Adhering Nylon Tapes*, Oct. 18, 1958, vol. 168, No. 7, p. 930.

*Primary Examiner*—Werner H. Schroeder
*Assistant Examiner*—Peter Nerbun
*Attorney, Agent, or Firm*—Crandell & Polumbus

[57] ABSTRACT

A hat having an adjustable sweat band for controlling the tightness of the fit of the hat. A hat is provided with a sweat band of a flexible material having a draw strap secured at one end to the band and extending circumferentially of the sweat band on the side of the band adjacent the crown. Cooperating fastening means at the free end of the strap and on the band are employed to adjustably locate the free end of the strap relative to the band so that the effective circumference of the sweat band, and thus the fit or size of the hat can be adjusted by a draw loop or drawstring arrangement which is shielded from contact with the wearer's head by the sweat band. A strip of resilient padding which may be of a moisture absorbent material extends circumferentially of the sweat band between the strap and sweat band to provide a further cushion between the fastening means and the head of the wearer.

1 Claim, 6 Drawing Figures

ADJUSTING DEVICE FOR HAT WITH SWEAT BAND

SUMMARY OF THE INVENTION

The present invention is especially directed to the provision of a hat whose fit may be selectively tightened or loosened for optimum comfort and security in differing wind or weather conditions.

A hat embodying the present invention includes a padded sweat band of flexible material secured along its lower edge only to the crown of the hat. A draw band is secured at one end on the inner side of the sweat band between the sweat band and crown and slidably retained in position by an elongated strip of material sewn to the sweat band above and below the band and defining with the sweat band a passage loosely enclosing the draw band. The passage defining strip does not extend completely around the circumference of the sweat band, its opposite ends being spaced by a gap into which the free end of the draw band projects. The draw band end is provided with a releasable securing means, preferably of the well known type sold under the trademark VELCRO which engages a cooperating fastening unit fixed to the band in the gap to enable the draw band to be tightened or loosened to thereby vary the effective circumference of the sweat band and thus the fit of the hat. The padding material, together with the sweat band, provides a cushioned shield between whatever portions of the VELCRO fastener, which is rather abrasive, and the wearer's head.

Other objects and features of the invention will become apparent by reference to the following specification and to the drawings.

IN THE DRAWINGS

Figure 1:
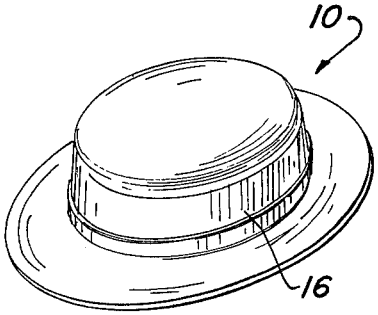
FIG. 1 is a perspective view of an exemplary form of hat embodying the present invention.
Figure 2:
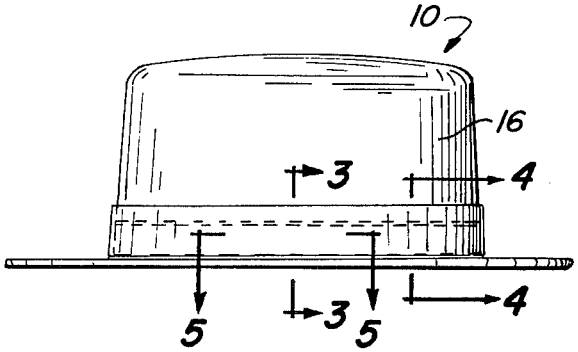
FIG. 2 is a side elevational view of the hat of FIG. 1.

In the drawings, the present invention is shown as applied to a sports hat designated generally 10 of a type commonly worn by golfers, fishermen, etc. which is constructed of a relatively soft flexible cotton or synthetic fabric. The invention is especially designed for hats used in such activities where a relatively loose fit is found more comfortable in hot weather and where a somewhat tighter fit may be desirable on windy days. The capability of tightening or loosening the fit of the hat as desired is achieved by what might be best described as an adjustable sweat band whose construction is best shown in FIGS. 3 through 6 of the drawings.

In accordance with the present invention, the hat 10 is provided with a sweat band 12 of a suitable flexible fabric material which is secured along its lower edge as by stitching 14 to the interior of the crown 16 of the hat. Sweat band 12 is smooth and continuous around the entire inner periphery of the hat crown and a strip of resilient padding material 18 which may have moisture absorbing properties, is stitched in place to the inner or crown facing side of sweat band 12.

Figure 6:
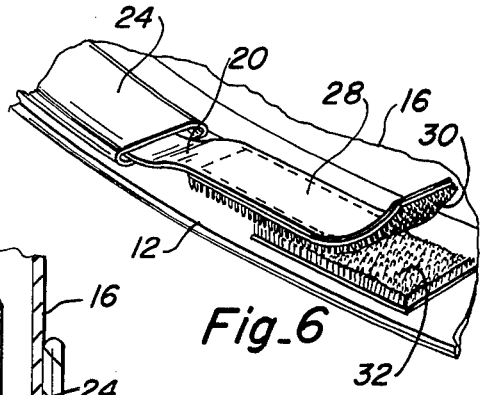
FIG. 6 is a detail perspective view of one form of fastening means employed in the present invention.
Figure 3:
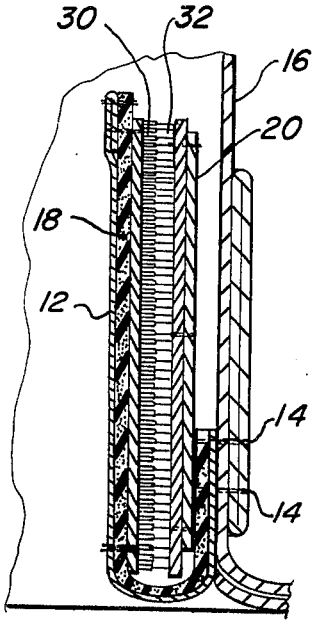
FIG. 3 is a detail cross-sectional view of the hat taken on lines 3—3 of FIG. 2.
Figure 4:
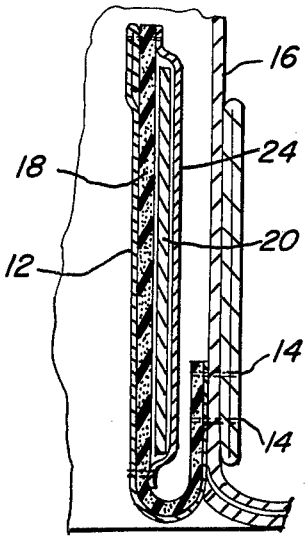
FIG. 4 is a detail cross-sectional view taken on line 4—4 of FIG. 2.
Figure 5:
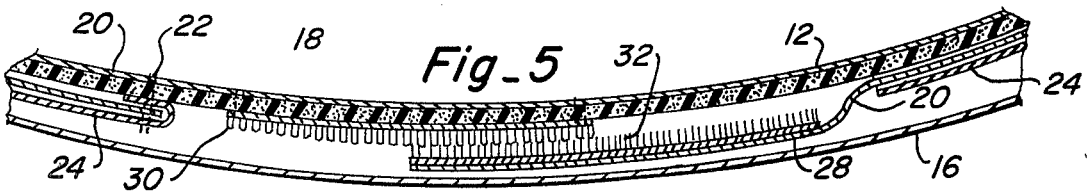
FIG. 5 is a detail cross-sectional view taken on the line 5—5 of FIG. 2.

A draw band 20 of a suitable fabric is stitched at one end as at 22 (FIG. 5) to the inner or crown facing side of the padded sweat band and extends circumferentially around the band, preferably over a major of the circumference of the band. Draw strip 20 is slidably confined in position against the inner side of the sweat band by an elongate retaining strip 24 which is stitched to the inner side of the sweat band above and below draw band 20 to loosely hold draw band 20 in position. The circumferential extent of retaining strip 24 is less than that of draw band 20 and, as best seen in FIGS. 5 and 6, the free or unsecured end 28 of band 20 projects freely beyond the open end of strip 24. Mating pads of VELCRO (trademark) material 30 and 32 are stitched respectively to the distal or free end 28 of band 20 and to the inner side of the padded sweat band at a location between the opposite ends of retaining strip 24 as best seen in FIGS. 5 and 6. The VELCRO (trademark) pads 30 and 32 are respectively provided with the interengaging hook and loop construction of this well-known fastening material which enables the free end 28 of band 20 to be detachable secured at selected positions of circumferential adjustment relative to sweat band 12 by simply pressing the two mating VELCRO (trademark) pads against each other.

It is believed apparent that by selecting the circumferential position at which band 20 is secured to the VELCRO (trademark) anchoring pad 32, the effective circumference of the hat band may be adjusted at will over the range permitted by the circumferential extent of the two VELCRO (trademark) pads to thereby enable the tightness of fit of the hat to be adjusted as desired within this range. By locating the draw band and the VELCRO (trademark) fastening means on the inner side of the sweat band, and by the provision of the padding strip 18, the adjusting means is not only concealed when the sweat band is in its normal position, but further, the fastening means are padded and cushioned so that they do not press against the wearer's head when the arrangement is adjusted for a relatively tight fit. With the VELCRO (trademark) fastening means or with other hook and eye type fastening means, this latter feature is desirable because exposed portions of the VELCRO (trademark) strips can be quite abrasive when pressed against the skin and other fastening means employing metal or plastic hooks can likewise become uncomfortable if not cushioned. The padding strip 18 can further be made of a moisture absorbent material if desired.

While one embodiment of the invention has been described in detail, it will be apparent to those skilled in the art that the disclosed embodiment may be modified. Therefore, the foregoing description is to be considered exemplary rather than limiting and the true scope of the invention is that defined in the following claims.

I claim:

1. In a hat having a crown and a continuous inturned sweat band of flexible material secured along its lower edge to the lower internal periphery of the crown and lying along the inner surface of the crown; the improvement comprising draw band means permanently secured at one end to said sweat band at the inner side of said sweat band adjacent said crown and extending circumferentially along a portion of the interior circumference of the sweat band, a passage defining strip overlying said draw band means and secured to said sweat band above and below said draw band means to define a pasage loosely enclosing said draw band means, said passage defining strip being of a circumferential extent less than that of the draw band, and cooperating flexible universally adjustable fastening means on said sweat band and said draw band for detachably securing the opposite end of said draw band to said sweat band, said fastening means being operable for adjusting the circumferential position of said draw band relative to said sweat band at any position falling within a given range of adjustment thereby to selectively adjust the fit of said hat to the head and comfort of a wearer.

* * * * *